US005277345A

United States Patent [19]

Ozaki

[11] Patent Number: 5,277,345

[45] Date of Patent: Jan. 11, 1994

[54] DRESS HANGER

[76] Inventor: Hiroyoshi Ozaki, 47, Koaza Kitahata, Oaza Ichisaka, Kizu-cho, Soraku-gun, Kyogo, Japan

[21] Appl. No.: 890,254

[22] Filed: May 29, 1992

[51] Int. Cl.[5] ..... A47G 25/30

[52] U.S. Cl. ..... 223/98; 223/92; 223/85; 223/88; 223/95; 156/86; 156/84

[58] Field of Search ..... 223/85, 87, 92, 95, 223/88, 98; 211/113; D6/315; 156/84, 86; 264/342 R

[56] References Cited

U.S. PATENT DOCUMENTS

| | | | |
|---|---|---|---|
| 2,061,266 | 11/1936 | Young | 223/87 |
| 2,158,465 | 5/1939 | Ligon | 223/87 |
| 2,203,006 | 6/1940 | Young | 223/85 |
| 2,989,191 | 6/1961 | Eason | 223/85 |
| 3,209,965 | 10/1965 | Tillery | 223/87 |
| 5,009,730 | 4/1991 | Tozier | 156/86 |
| 5,074,446 | 12/1991 | Suddath | 223/85 |
| 5,078,307 | 1/1992 | Suddath | 223/85 |

FOREIGN PATENT DOCUMENTS

| | | | |
|---|---|---|---|
| 2623104 | 12/1977 | Fed. Rep. of Germany | 223/85 |
| 4007320 | 9/1991 | Fed. Rep. of Germany | 223/85 |
| 2242122 | 9/1991 | United Kingdom | 223/85 |

*Primary Examiner*—Clifford D. Crowder
*Assistant Examiner*—Bibhu Mohanty
*Attorney, Agent, or Firm*—Wenderoth, Lind & Ponack

[57] ABSTRACT

Heat-shrinkable tubes are fitted on a dress hanger or its clips and are then shrunk by heating them until the tubes are tightly secured to the hanger or its clips. The tubes are flocked or are otherwise provided with a constituent exhibiting a non-slip property at locations where the tubes will come into contact with clothes hung on the hanger. The clothes are thus prevented from slipping on the hanger.

6 Claims, 8 Drawing Sheets

DRESS HANGER

BACKGROUND OF THE INVENTION

This invention relates to a dress hanger with non-slip means and a method of manufacturing the same.

As shown in FIG. 16, a conventional hanger generally comprises a hook 1, arms 2 extending in opposite directions from the hook 1, and a hanger bar 3. The arms 2 are used for hanging a suit, a blouse, etc. and the hanger bar 3 is used for hanging pants and a skirt.

Various means have been proposed to prevent the clothes hung on the arms 2 and the bar 3 from slipping thereon and becoming wrinkled. One of such means is to attach flocked cloth patches S to the arms 2 and the bar 3. However, it is difficult to attach such patches to the arms 2 so that they will fit perfectly on the surface thereof. Thus, they can peel off easily while in use. Further, such patches will give the hanger a less attractive appearance.

Some of the conventional hangers have clamp (11 in FIG. 9) attached to the arms 2 or the bar 3 to clip a skirt or the like. Conventional non-slip means used for such clips include synthetic resin coatings provided on the clip surfaces and resilient members C such as sponge bonded to the clip surfaces as shown in FIG. 17.

Such coatings are usually formed by dipping and thus their workability and working environment are not good. Further, since their thickness tends to be uneven, such clips tend to leave clipping marks on clothes. The resilient members C peel off easily.

SUMMARY OF THE INVENTION

An object of the present invention is to provide a component exhibiting a non-slip property which can be attached easily on the hanger, and which is more durable and which is less liable to leave marks on clothes.

In order to solve the above problems, according to the present invention, there is provided a dress hanger comprising a hook, arms extending in opposite directions from the hook and tubes fitted tightly on the arms by shrinking the tubes by heating, the tubes having constituents at their outer surfaces which provide a non-slip property at locations where the tubes will come into contact with clothes draped over the arms.

The constituents may be sheets of sponge having their side edges joined to a heat-shrinkable film of the tube.

From another aspect of this invention, there is provided a dress hanger comprising a hook, arms extending in opposite directions from the hook, a hanger bar extending between the arms and a heat-shrinkable tube fitted tightly on the bar by shrinking the tube by heating, the tube having a constituent at its outer surface which provides a non-slip property at a location where the tube will come into contact with clothes draped over the hanger bar.

From another aspect of this invention, there is provided a clip for a dress hanger comprising a clip body and tubes fitted tightly on clip portions of the clip body by shrinking the tubes by heating, each of the tubes being provided with no-slip means on the surface thereof at locations where the tubes will come into contact with clothes clamped by the clips.

The heat-shrinkable tubes having predetermined lengths are fitted on desired portions of the hanger and shrunk by heating to fasten the tubes to the hanger.

The constituent providing the non-slip properties may be sponge, flock or rubber cement.

The dress hanger according to the present invention exhibits the same non-slip properties as the prior art. Further, the tubes can be shrunk by heating so as to fit snugly around the arms or the hanger bar. Also, since the tube never peels, it will exhibit its non-slip properties for a prolonged period of time.

The tubes are fastened to the arms, the hanger bar or the clips of the hanger by shrinking them by heating. Thus, their workability is very good and they can exhibit non-slip properties for a prolonged period of time.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENT

Embodiment 1

Figure 1:
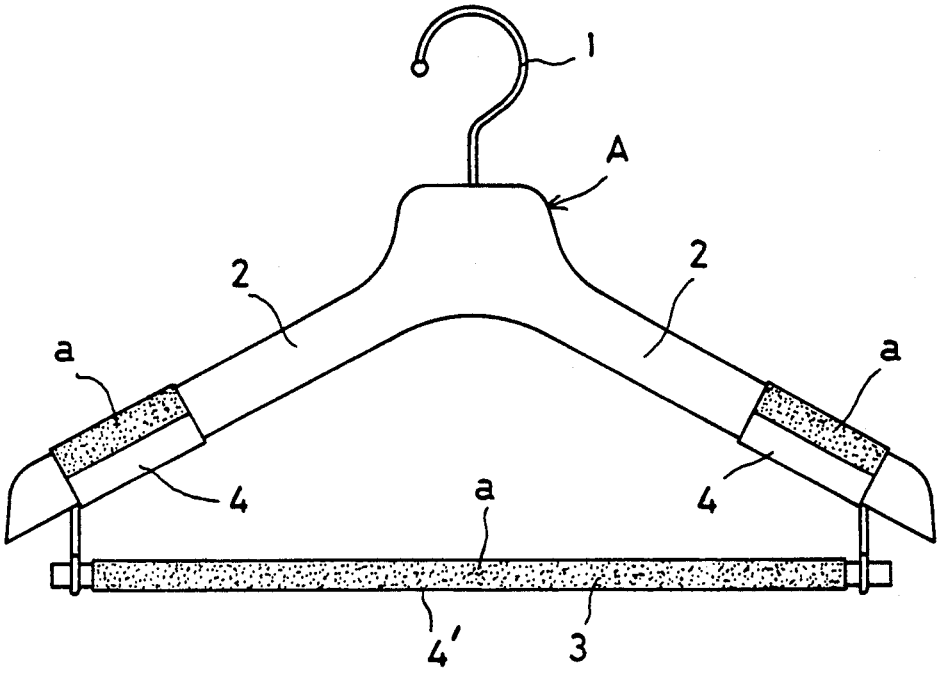
FIG. 1 is a front view of one embodiment of a hanger according to the present invention.

FIG. 1 shows the first embodiment. The dress hanger A of this embodiment comprises a hook 1, arms 2 extending in opposite directions from the hook 1 and a hanger bar 3 extending between the arms 2. Tubes 4 having flock a are fitted on the hanger and fixed in position by heat shrinking.

Figure 2:
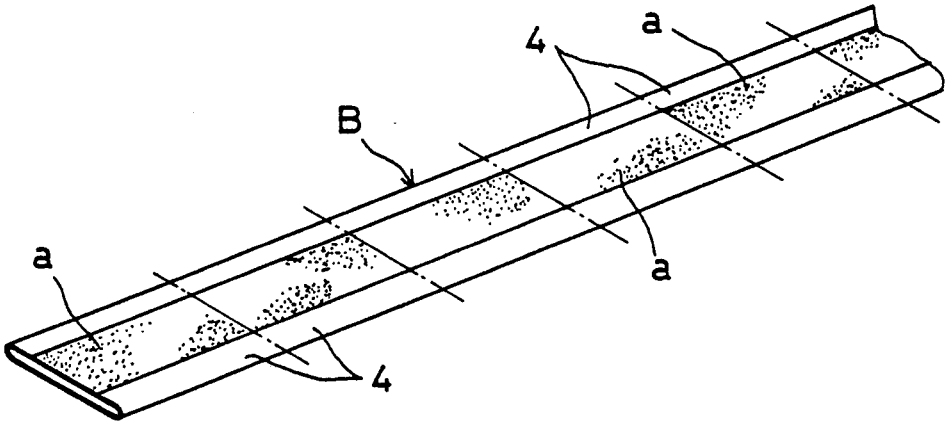
FIG. 2 is a view showing how the tubes of the hanger are made.

More specifically, as shown in FIG. 2, a tube B of a heat-shrinkable synthetic resin and having flock on part of its surface is prepared. The tube B is cut into lengths as shown by chain lines in FIG. 2 to form the short tubes 4 having a predetermined length.

Figure 3A:
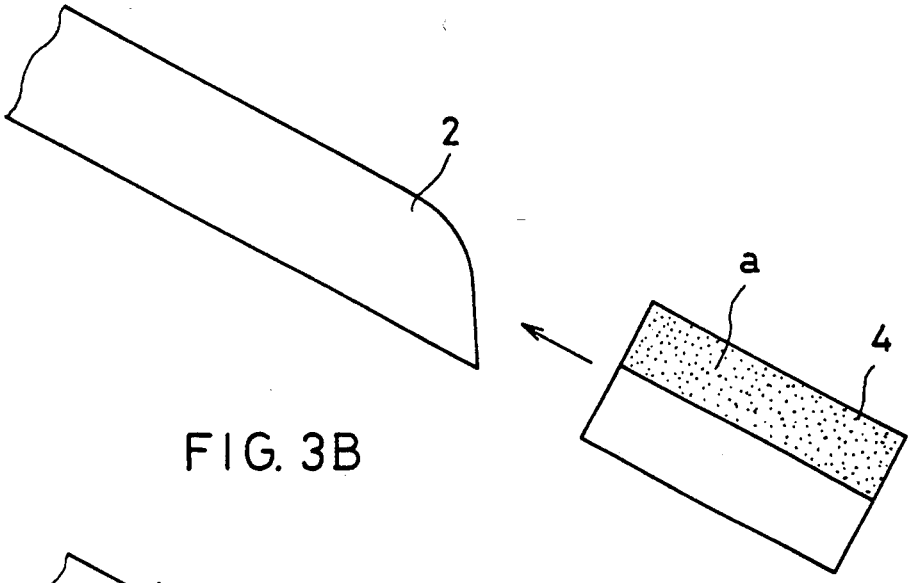
FIGS. 3A–3C are views showing how the tubes are fitted and secured to the arms of the hanger.
Figure 3B:
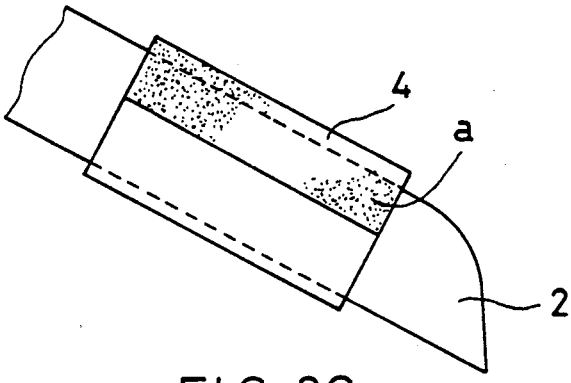
Figure 3C:
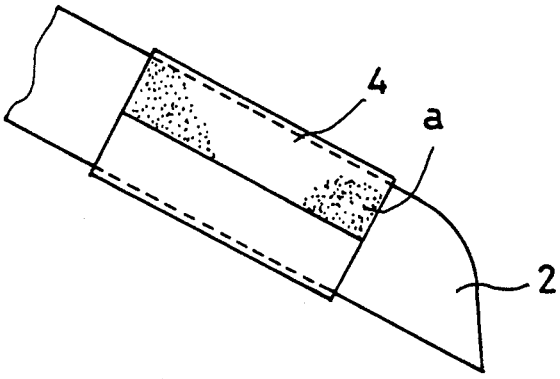

The tubes are fitted on the arms 2 as shown in FIGS. 3A and 3B and are heated to shrink and fix them to the arms 2 as shown in FIG. 3C.

Figure 4:
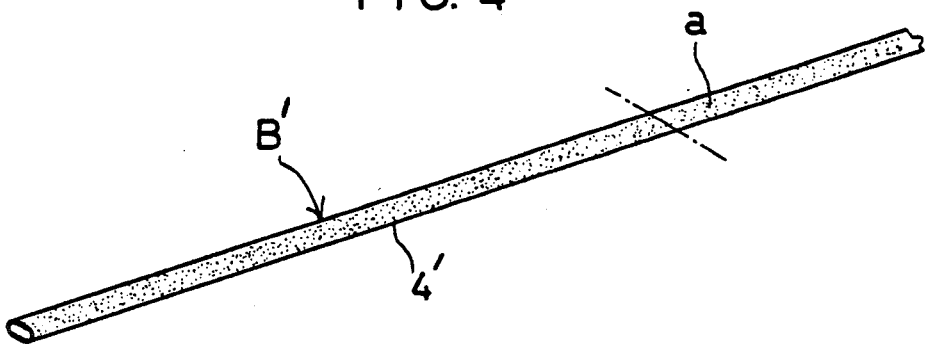
FIGS. 4 to 7 are views showing how other tubes of the present invention are made.

As shown in FIG. 4, another heat-shrinkable tube B′ having its entire surface flocked is prepared. The tube B′ is cut as shown by chain lines of FIG. 4 to form tubes 4′ having a predetermined length. The tubes 4′ are fitted on the hanger bar 3 and heated to shrink and fix them to the bar 3. Then as shown in FIG. 1, the hanger bar 3 is hooked to the arms 2.

Figure 5:
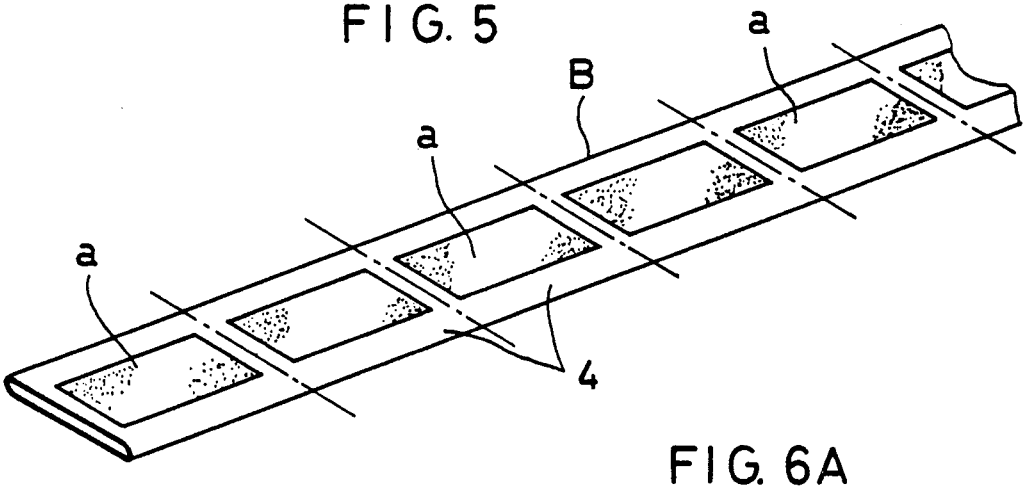
Figure 6A:
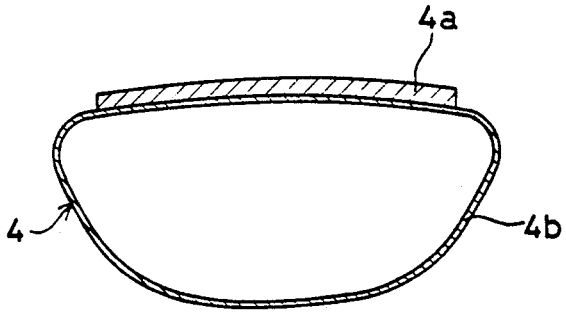
Figure 6B:
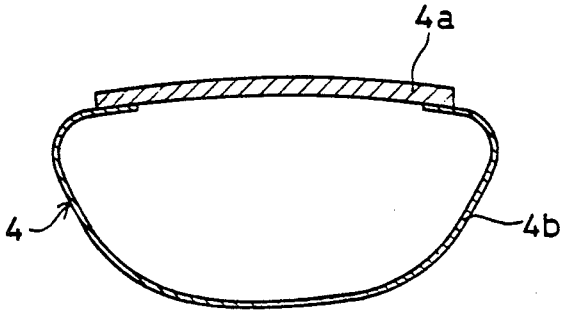

Instead of having the entire surface of the tube B flocked, it may be flocked only at portions of its surface which are to be brought into contact with clothes. For example, as shown in FIG. 5, a plurality of flocked portions a may be provided at predetermined intervals. Also, as shown in FIG. 6A, instead of providing flocked portions a, a non-slip material **4*a*** such as sponge may be stuck on the surface of the tube B. Otherwise, as shown in FIG. 6B, only the portion of the tube to be brought into contact with clothes may be formed of a non-slip material 4*a* while the remainder of the tube is formed of a heat-shrinkable film 4*b*. The boundaries therebetween are connected together in a conventional manner such as by welding or bonding.

It is also not necessary to have the entire surface of the tube B' flocked. Only its portions to be brought into contact with clothes may be flocked. Also, such portions may be formed of a non-slip material 4*a* such as sponge.

Figure 7A:
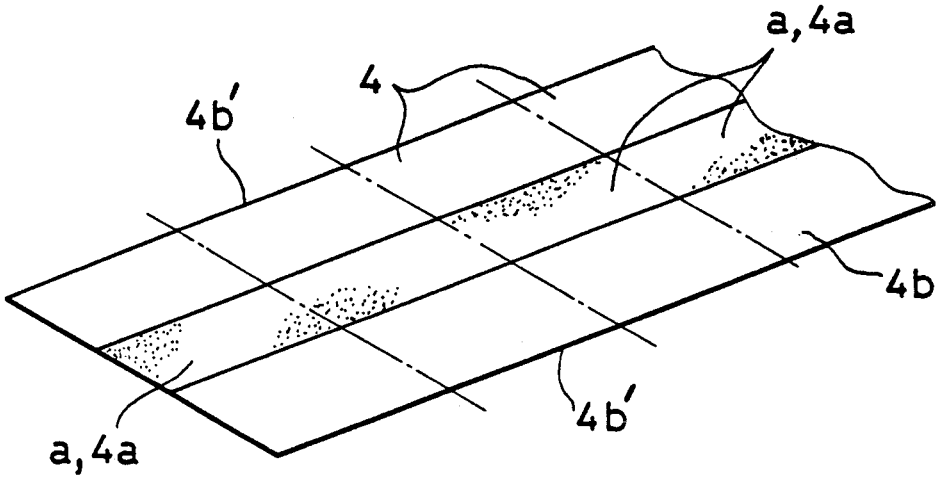
Figure 7B:
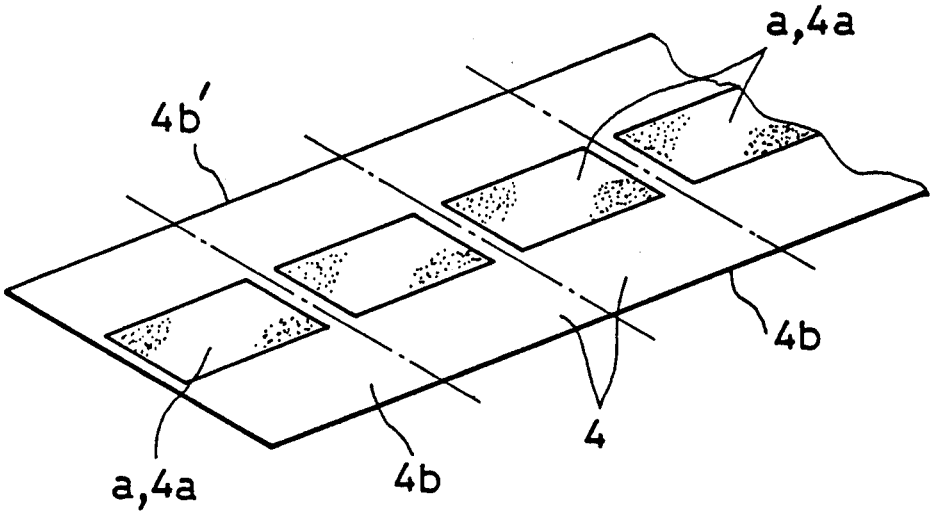
Figure 8:
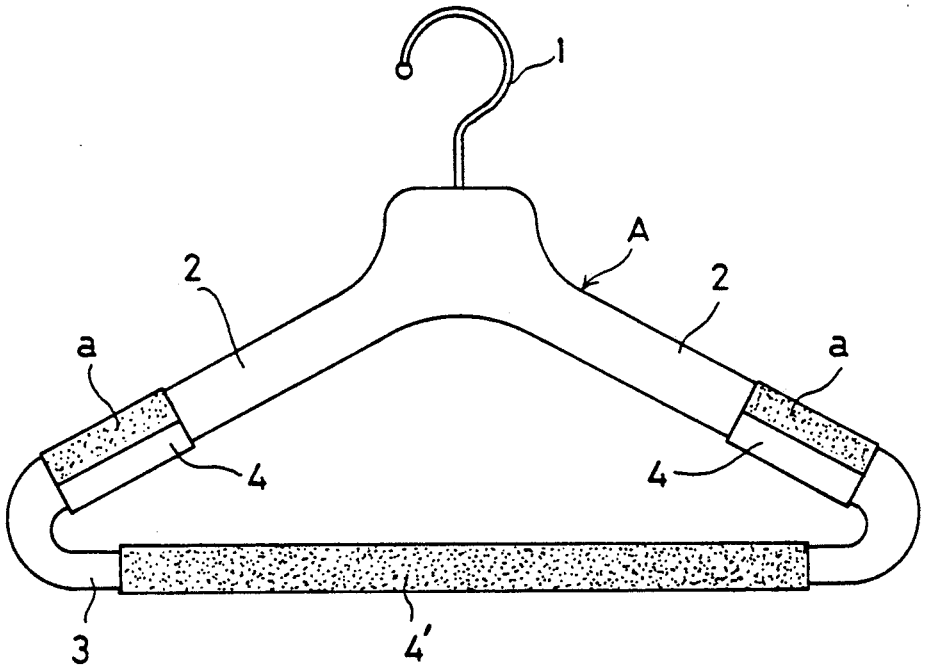
FIG. 8 is a front view of another embodiment of a hanger according to the present invention.

Also, as shown in FIGS. 7A and 7B, the tube B or B' may be made of a heat-shrinkable film 4*b* having its edges 4*b*' bonded or welded together. Each film is provided with a strip of flock a or a non-slip material 4*a* extending over the entire length thereof (FIG. 7A) or with a plurality of such strips arranged at predetermined intervals in the longitudinal direction thereof (FIG. 7B). The films 4*b* may be bonded to form a tube after they are fitted on the arms 2 or the hanger bar 3. With this arrangement, the tubes can be fitted even on a hanger having its arms 2 and hanger rod 3 integrally formed (shown in FIG. 8).

In the case of a dress hanger A having no hanger bar 3, the tubes 4 are fitted on its arms as non-slip means.

Embodiment 2

Figure 9:
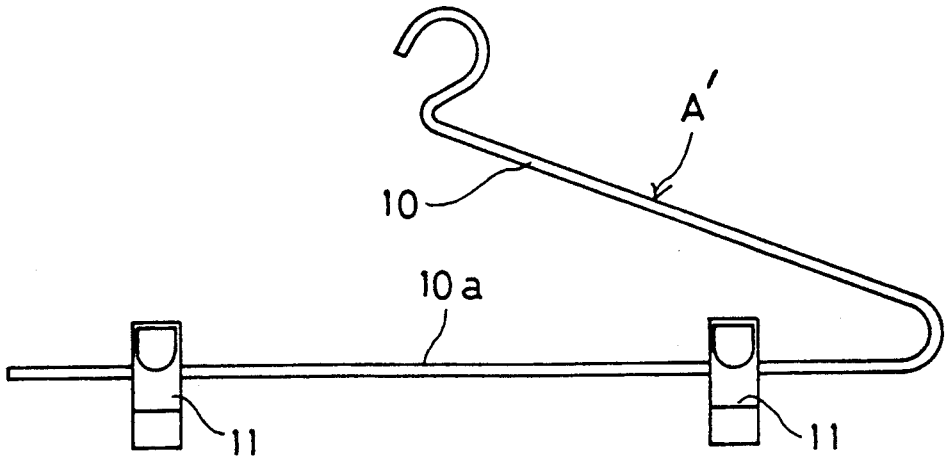
FIG. 9 is a front view of still a further embodiment.

As shown in FIG. 9, this embodiment is a dress hanger A' for hanging a skirt by clamping it with a pair of clips 11 secured to a hanger body 10 made of a stainless steel wire.

Figure 10:
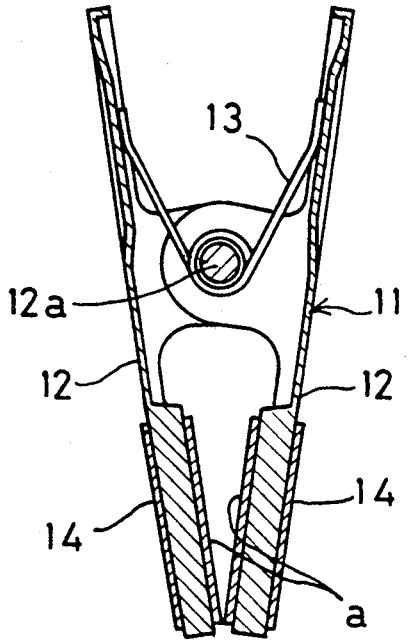
FIGS. 10 to 13 are sectional views of clips of the present invention.

As shown in FIG. 10, each clip 11 comprises a pair of clip arms 12, a pivot shaft 12*a* pivotally supporting the clip arms 12 and a spring 13 biasing the clipping arms 12 toward a closed position. Tubes 14 provided with portions of flack a are fitted on the clipping portions of the clip arms 12.

Figure 14:
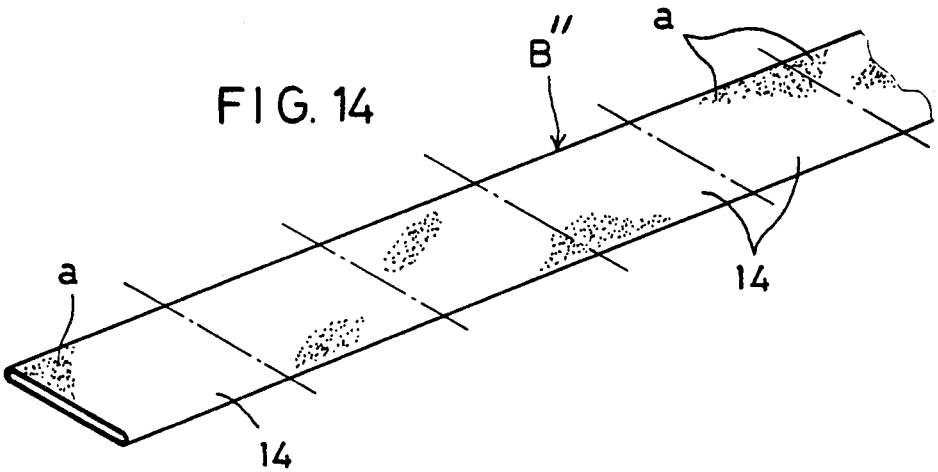
FIGS. 14 and 15 are views showing how tubes of the clips are made.
Figure 15:
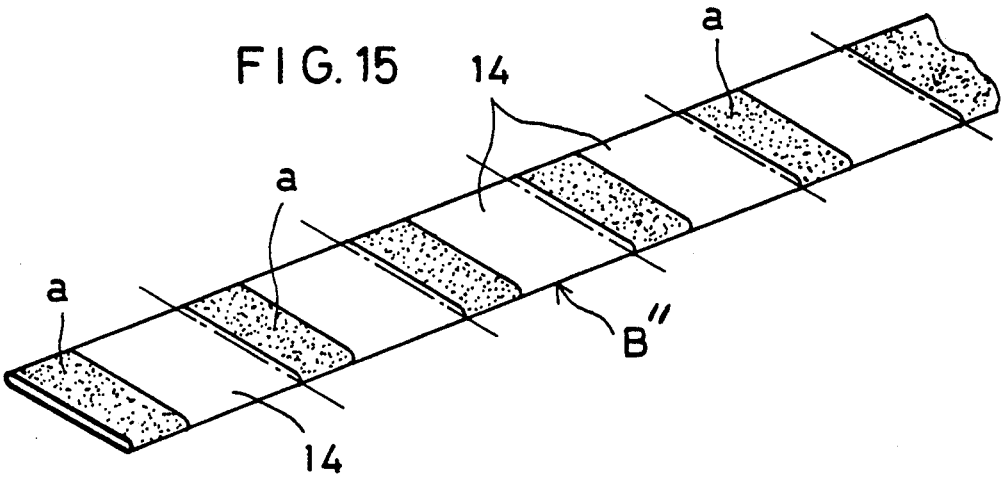
Figure 16:
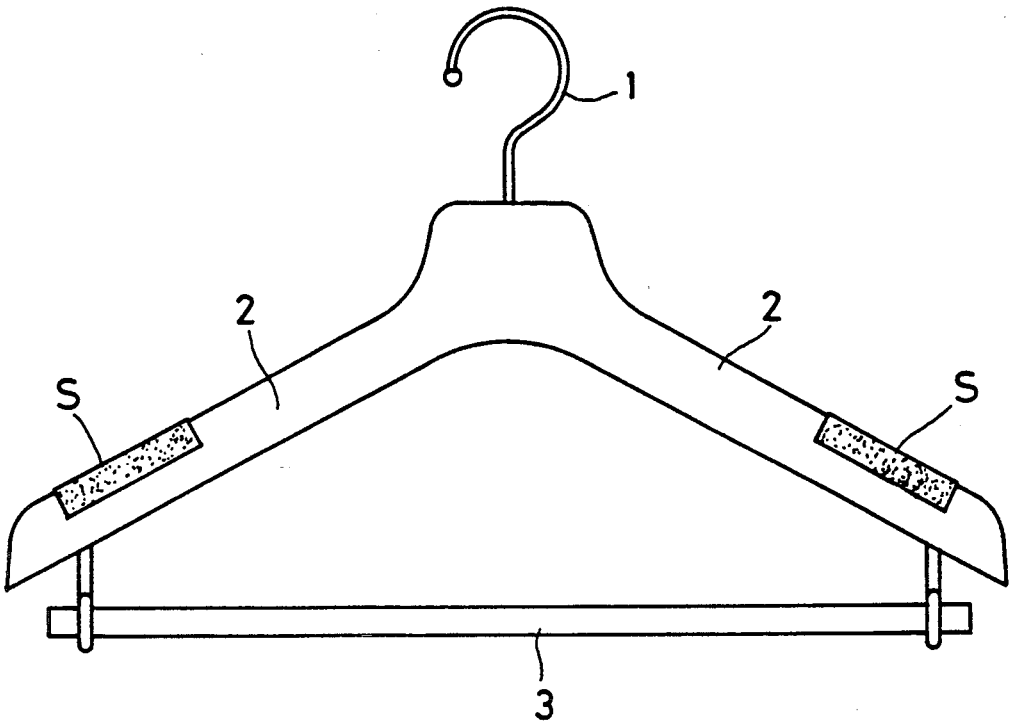
FIG. 16 is a front view of a prior art hanger.
Figure 17:
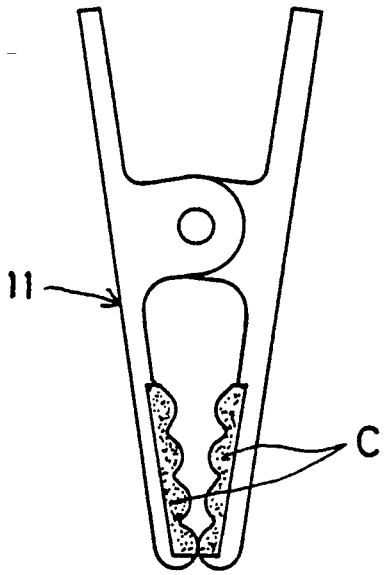
FIG. 17 is a sectional view of a prior art dress clip.

As shown in FIG. 14, the tubes 14 are made by cutting to predetermined lengths, a tube B'' made of a heat-shrinkable synthetic resin and having flock a over the entire surface thereof. The tubes 14 are fitted on the hanger and are shrunk by heating to fix them in position. As shown in FIGS. 2, 5 and 15, the tubes B'' may be provided with flock a only at portions to be brought into contact with clothes. Also, as shown in FIGS. 6A and 6B, the tube B may comprise a non-slip member 4*a* such as sponge and a heat-shrinkable film 4*b*. As shown in FIGS. 7A and 7B, the film may be formed into a tube by bonding its side edges together.

Figure 11:
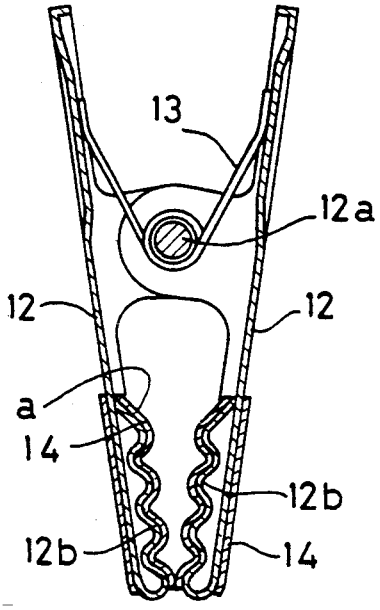
Figure 12:
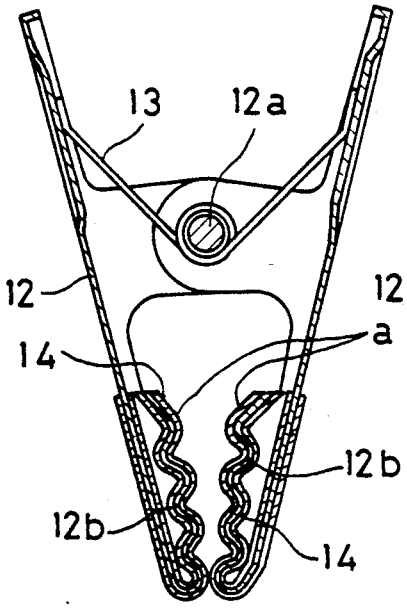
Figure 13:
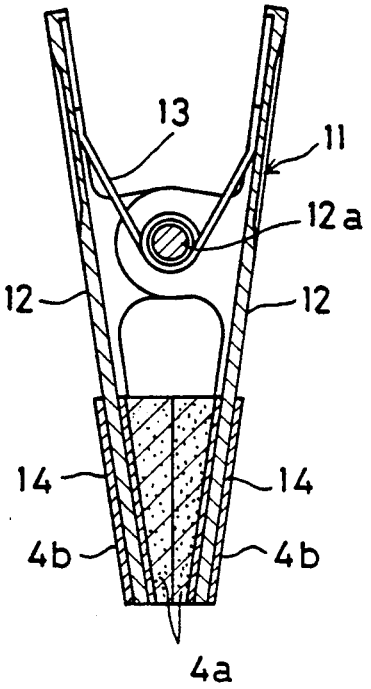

As shown in FIG. 11, the clip arms 12 may have their clip end portions 12*b* turned in so that when clamping clothes, they are positioned parallel to each other. The clip end portions 12*b* should preferably have a corrugated cross-sectional shape as shown in the same figure. The tubes 14 may be fitted to cover the entire length of the clip end portions.

Similarly, in the case of the dress hanger A' shown in FIG. 9, the tube B' may be fastened to the horizontal portion 10*a* of the body 10 except at the clips 11.

The cutting of the tubes B, B' and B'' and the fitting and heat-shrinking of the tubes 4, 4' and 4'' can be done manually or automatically. The fibers constituting the flock may be of any kind as long as they have non-slip properties.

What is claimed is:

1. A dress hanger comprising: a hook, shoulder-supporting arms extending in opposite directions from said hook over such a distance that said arms are capable of carrying shoulder portions of an ordinary piece of clothing hung thereon, and tubes each comprising a film of heat-shrinkable material extending tightly around and heat-shrunk to said arms, said tubes having portions of sponge at outer surfaces thereof which provide a non-slip property, the portions of sponge being provided at locations where said tubes will come into contact with clothes hung on said arms of the hanger thereby preventing clothes from slipping from the arms of the hanger.

2. A dress hanger as claimed in claim 1, wherein each of said tubes has side edges that are joined together.

3. A dress hanger as claimed in claim 1, wherein said sponge has side edges joined to respective side edges of said film of heat-shrinkable material.

4. A method of manufacturing a dress hanger, said method comprising the steps of: providing a dress hanger having a hook, and two arms extending in opposite directions from the hook; providing a plurality of heat-shrinkable tubes each of a predetermined length, and each having a constituent providing a non-slip property at the outer surface of the tube by providing films of heat-shrinkable material and securing sponge as said constituent to each of the films, respectively; positioning respective ones of said tubes of predetermined lengths around said arms of the hanger with the constituent providing the non-slip property being located at portions of said arms of the hanger which will contact clothing carried by said arms; and shrinking each of said tubes by heating the film thereof to fasten the tube to the hanger whereby clothes carried by said arms of the hanger will be prevented from slipping therefrom by the sponge of each of said tubes which provides the non-slip property.

5. A method of manufacturing a dress hanger as claimed in claim 4, wherein the step of providing each of the heat-shrinkable tubes includes securing side edges of the sponge to respective side edges of the film of heat-shrinkable material.

6. A method of manufacturing a dress hanger as claimed in claim 4, wherein the step of providing a hanger comprises providing a hanger having a hanger bar extending between end portions of the arms remote from the hook, and the step of positioning comprises positioning a said heat-shrinkable tube around the hanger bar.

* * * * *